US007852062B2

(12) United States Patent
Sugimura

(10) Patent No.: US 7,852,062 B2
(45) Date of Patent: Dec. 14, 2010

(54) REFERENCE CURRENT GENERATING APPARATUS

(75) Inventor: Naoaki Sugimura, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 366 days.

(21) Appl. No.: 12/135,410

(22) Filed: Jun. 9, 2008

(65) Prior Publication Data

US 2008/0315857 A1 Dec. 25, 2008

(30) Foreign Application Priority Data

Jun. 25, 2007 (JP) ..... 2007-165960

(51) Int. Cl.
*G05F 3/16* (2006.01)

(52) U.S. Cl. ..... 323/316; 323/281

(58) Field of Classification Search ..... 323/314, 323/315, 316, 317, 281
See application file for complete search history.

(56) References Cited

U.S. PATENT DOCUMENTS

| | | | | |
|---|---|---|---|---|
| 5,796,244 | A * | 8/1998 | Chen et al. | 323/313 |
| 5,910,726 | A * | 6/1999 | Koifman et al. | 323/315 |
| 6,346,803 | B1 * | 2/2002 | Grossnickle et al. | 323/315 |
| 6,501,256 | B1 | 12/2002 | Jaussi et al. | |
| 6,600,303 | B2 * | 7/2003 | Ikehashi | 323/315 |
| 6,642,778 | B2 * | 11/2003 | Opris | 327/539 |
| 6,885,179 | B1 * | 4/2005 | Ker et al. | 323/316 |
| 7,170,274 | B2 * | 1/2007 | Mukherjee et al. | 323/313 |
| 7,253,598 | B1 * | 8/2007 | Doyle et al. | 323/316 |
| 7,504,814 | B2 * | 3/2009 | Lee et al. | 323/316 |
| 7,629,785 | B1 * | 12/2009 | Drebinger | 323/313 |
| 7,755,344 | B2 * | 7/2010 | Hsieh | 323/315 |

FOREIGN PATENT DOCUMENTS

JP 2000075947 3/2000

OTHER PUBLICATIONS

Hironori Banba et al., A CMOS Bandgap Reference Circuit with Sub-1-V Operation; IEEE Journal of Solid-State Circuits, vol. 34, No. 5, May 1999.

* cited by examiner

*Primary Examiner*—Adolf Berhane
(74) *Attorney, Agent, or Firm*—Volentine & Whitt, P.L.L.C.

(57) ABSTRACT

A reference current generating apparatus is provided which is capable of generating a reference current having no temperature dependency, without increasing a layout area. The reference current generating apparatus includes a constant current generating circuit having a differential amplifier, a constant current generating circuit connected to the constant current generating circuit and having a differential amplifier, and an output circuit connected to the constant current generating circuit for outputting first and second reference voltages. The constant current generating circuit generates a reference current by enabling selection of a mirror ratio of a transistor that conducts summing of a constant current proportional to a thermal voltage, and by enabling switching of a dividing voltage from a resistor to an input of the differential amplifier, to generate a constant current proportional to a diode voltage via a high impedance MOS gate.

9 Claims, 4 Drawing Sheets

REFERENCE CURRENT GENERATING APPARATUS

BACKGROUND OF THE INVENTION

1. Field of the Invention

The present invention generally relates to a reference current generating apparatus for generating an electric reference current (which may hereinafter be referred to as a reference current), in order to generate an electric reference voltage (which may hereinafter be referred to as a reference voltage) in a semiconductor integrated circuit. More particularly, the present invention relates to a reference current generating apparatus which is capable of adjusting non-uniformity of a reference current which might occur due to, for example, an error in the accuracy of resistance ratio and the like which may occur during manufacture of the apparatus.

2. Description of the Related Art

A typical example of a conventional electric circuit for generating a reference current in order to generate a reference voltage is disclosed in Japanese Laid-open Patent Application Publication No. 2000-75947. A band gap reference circuit (BGR circuit) is shown in FIG. 3 of Japanese Laid-open Patent Application Publication No. 2000-75947, and includes an operational amplifier used to generate a reference current. The reference current is a combination of a constant current proportional to a thermal voltage, and a current proportional to a diode voltage. An operation bias current of the operational amplifier is generated using the reference current.

In addition, a band gap reference circuit is shown in FIG. 5 of Japanese Laid-open Patent Application Publication No. 2000-75947. The band gap reference circuit shown in FIG. 5 includes a current source transistor that generates reference current (1/R1*(Vbe+R1/R3*kT/q*LN(n)), which is proportional to 1/R1 of a band gap voltage (Vbe+R1/R3*kT/q*LN(n)) and which has no dependency on temperature. The band gap reference circuit generates a constant reference voltage (=R4/R1*[Vbe+R1/R3*kT/q*LN(n)] at a Vref terminal by flowing the reference current through a load resistor R4 (884 kΩ) connected to the current source transistor. The constant reference voltage is R4/R1 times as high as the band gap voltage, and has no dependency on temperature. It is to be understood that Vbe is a terminal voltage of a diode, R1 is a resistor of 2063 kΩ, R3 is a resistor of 393 kΩ, k is Boltzmann's constant, T is absolute temperature, q is units of electric charge, and n is diode capacitance ratio.

Nevertheless, the band gap reference circuit disclosed in Japanese Laid-open Patent Application Publication No. 2000-75947 has no means for adjusting error in specific accuracy which may occur due to mismatch of resistor R4 and resistor R1 in view of manufacture thereof, and an error in specific accuracy which may occur due to mismatch of resistor R3 and resistor R1 in view of manufacture thereof, due to mask misalignment, dispersion of impurity concentration and the like. This makes it difficult for individual elements to generate a constant reference voltage (=R4/R1*[Vbe+R1/R3*kT/q*LN(n)]) having no dependency on temperature.

In the meantime, FIG. 1 of U.S. Pat. No. 6,501,256 shows a means for adjusting a mismatch error in specific accuracy of resistors in view of manufacture thereof, in a band gap reference circuit for generating a reference current, by summing a constant current proportional to a thermal voltage and a current proportional to a diode voltage.

However, in order to adjust a mismatch error in specific accuracy of resistor R2 and resistor R1 due to manufacture thereof (resistance of an output resistor 170/R1*[Vbe+R1/R2*kT/q*LN(n)]), the resistance of resistor R2 in FIG. 1 of U.S. Pat. No. 6,501,256 is varied by selectively switching on or off MOS switches 312 through 328 that are connected in series to parallel unit resistors of the resistor R2, as shown in FIG. 3. It should also be understood that here Vbe is a terminal voltage of diode D2, R1 is resistor 122, R2 is resistor 124, k is Boltzmann's constant, T is absolute temperature, q is units of electric charge, and n is diode capacitance ratio. The on-resistance of the MOS switches has a temperature dependency, which is different from the temperature dependency of resistors r, 2r, . . . , 16r shown in FIG. 3. This has an effect on the constant reference voltage (the resistance of the output resistor 170/R1*[Vbe+R1/R2*kT/q*LN(n)]). It is accordingly difficult to generate a constant reference voltage having no temperature dependency. If the on-resistances of the MOS switches are designed to be greatly smaller than the parallel unit resistances of the resistor R2 in order to avoid this difficulty, a problem arises in that a layout area of the MOS switches becomes very large.

SUMMARY OF THE INVENTION

To overcome this problem, it is an object of the invention to provide a reference current generating apparatus which is capable of generating a reference current having no temperature dependency, without increasing layout area.

To achieve the above object, according to the present invention, there is provided a reference current generating apparatus for generating a reference current, including a first constant current generator including a first current source transistor and a first diode connected to each other at a first connection node, a second current source transistor and a first resistor connected to each other at a second connection node, a second diode and the first resistor connected to each other at a third connection node, the second diode having a current capacity larger than a current capacity of the first diode, the first connection node and the second connection node respectively connected to inputs of a first differential amplifier that maintains the first and second connection nodes at an identical electric potential, gates of the first and second current source transistors connected to an output of the first differential amplifier, a transistor connected to the output of the first differential amplifier and that turns on the first and second current source transistors at a time when a power supply is turned on, and a third current source transistor connected to a second transistor by a fourth connection node and that biases the first differential amplifier via the fourth connection node;

a second constant current generator including a second differential amplifier having inputs, the third connection node connected to one of the inputs of the second differential amplifier, a fourth current source transistor and a second resistor connected to each other at a fifth connection node, the second resistor having a plurality of voltage dividing resistors connected in series to each other by dividing nodes, a voltage of a selected one of the dividing nodes of the second resistor being applied to another of the inputs of the second differential amplifier, gates of the fourth current source transistor and a fifth current source transistor are connected to an output of the second differential amplifier, a third transistor connected to the output of the second differential amplifier that turns on the fourth current source rasistor, the second transistor and a plurality of transistors forming a first current mirror connected to the fifth connection node via respective selected ones of the plurality of transistors to turn on the fourth current source transistor at the time when the power supply is turned on, and the fifth current source transistor connected to a fourth transistor by a sixth connection node and that biases the second differential amplifier via the sixth; and an output circuit including a sixth current source transistor connected to the output of the second differential amplifier, a seventh connection node between the sixth current source transistor and a third resistor providing a first reference output, and the fourth transistor and a fifth transistor connected to each other and forming a second current mirror, and an eighth connection node between the fifth transistor and a fourth resistor providing a second reference output.

According to the present invention, there is provided a reference current generating apparatus in which a differential amplifier is used for summing a constant current proportional to a thermal voltage and a constant current proportional to a diode voltage, thereby generating a reference current. This reference current generating apparatus includes circuitry for adjusting a non-uniformity of the reference current, which might occur due to a mismatch error in specific accuracy of resistances, in view of the manufacture thereof. The circuitry enables selection of a mirror ratio of a MOS transistor configured to conduct summing of the constant current proportional to the thermal voltage, and also enables a voltage node, which is divided when a dividing voltage is applied to a high impedance MOS gate, to be selectively switched to an input of the differential amplifier that generates a constant current proportional to the diode voltage.

With this configuration, it is possible to prevent temperature dependency of on-resistance of MOS switches from having an effect on a generated reference current in a configuration where resistance is varied by on/off selection of MOS switches inserted in series with resistors. In addition, although it has been necessary in a conventional configuration to increase a size of a MOS switch so that on-resistance of a MOS transistor switch can be extremely smaller than the resistance of a resistor connected in series to the MOS transistor, the configuration of this invention can prevent an increase in layout area.

In addition, when it is configured so that non-uniformity of a reference current is adjusted by selection of a dividing voltage of a resistor connected in series to a diode for a diode voltage input side of a differential amplifier that generates a constant current proportional to a diode voltage, it is possible to further enhance accuracy of adjustment.

BRIEF DESCRIPTION OF THE DRAWINGS

The above and other aspects and features of the present invention will become readily apparent from the detailed description that follows, with reference to the accompanying drawings, in which.

DESCRIPTION OF THE PREFERRED EMBODIMENTS

The present invention will now be described by way of preferred, but non-limiting embodiments of the invention. The referenced drawings are presented for illustrative purposes only, and are not intended to limit the scope of the invention.

Figure 1:
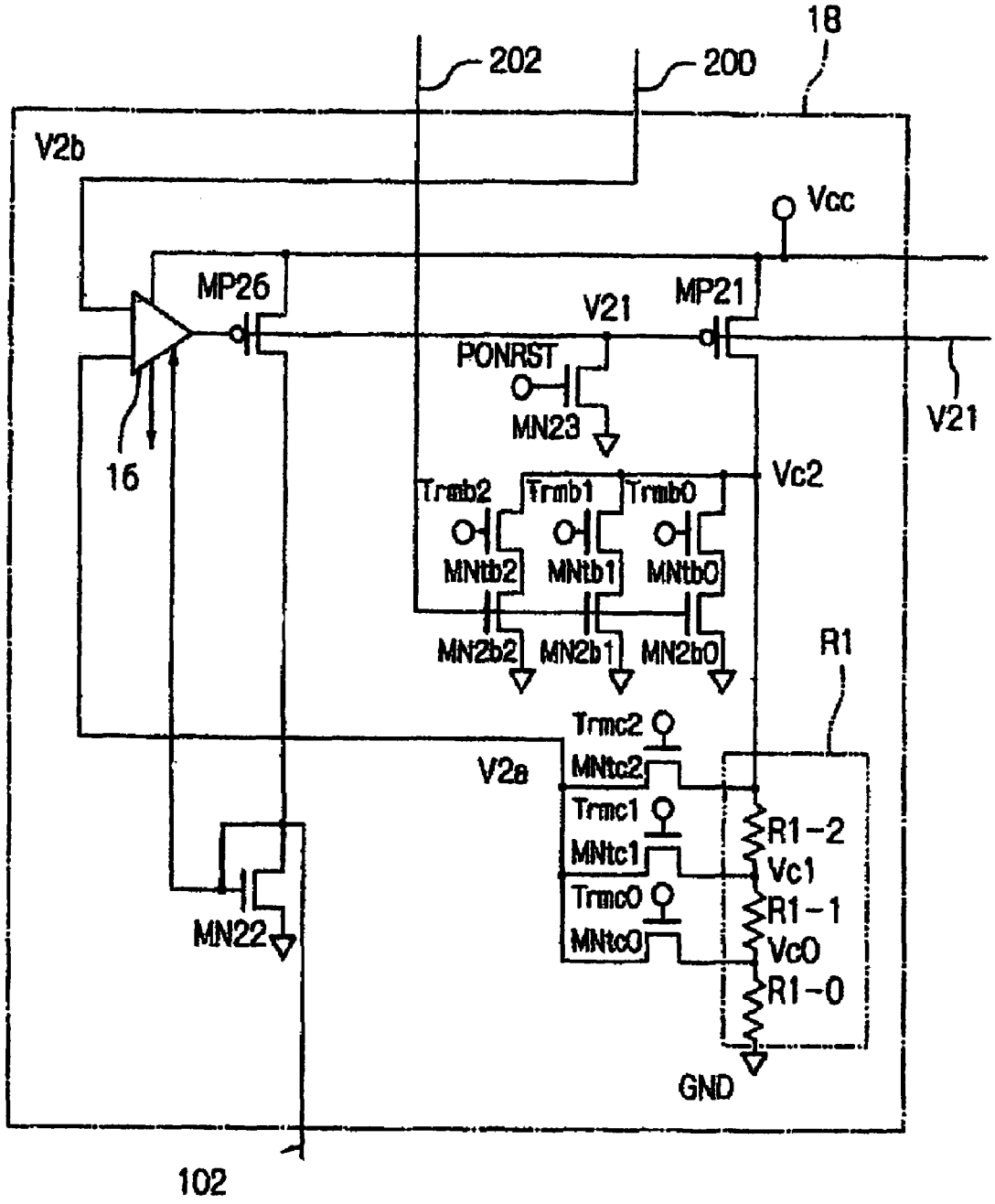
FIG. 1 is a circuit diagram showing an example configuration of a constant current generating circuit in a reference voltage generating circuit according to an embodiment.

Now, a reference current generating circuit according to an embodiment of the present invention will be described in detail with reference to the accompanying drawings. FIG. 3 shows an entire configuration of a reference current generating circuit to which the principles of the present invention are applied. Reference current generating circuit 10 includes a constant current generating circuit 14, a constant current generating circuit 18 connected to the constant current generating circuit 14, and an output circuit 20 connected to the constant current generating circuit 18. The internal configuration of the constant current generating circuit 14 is shown in FIG. 2, and the internal configuration of the constant current generating circuit 18 is shown in FIG. 1.

Figure 2:
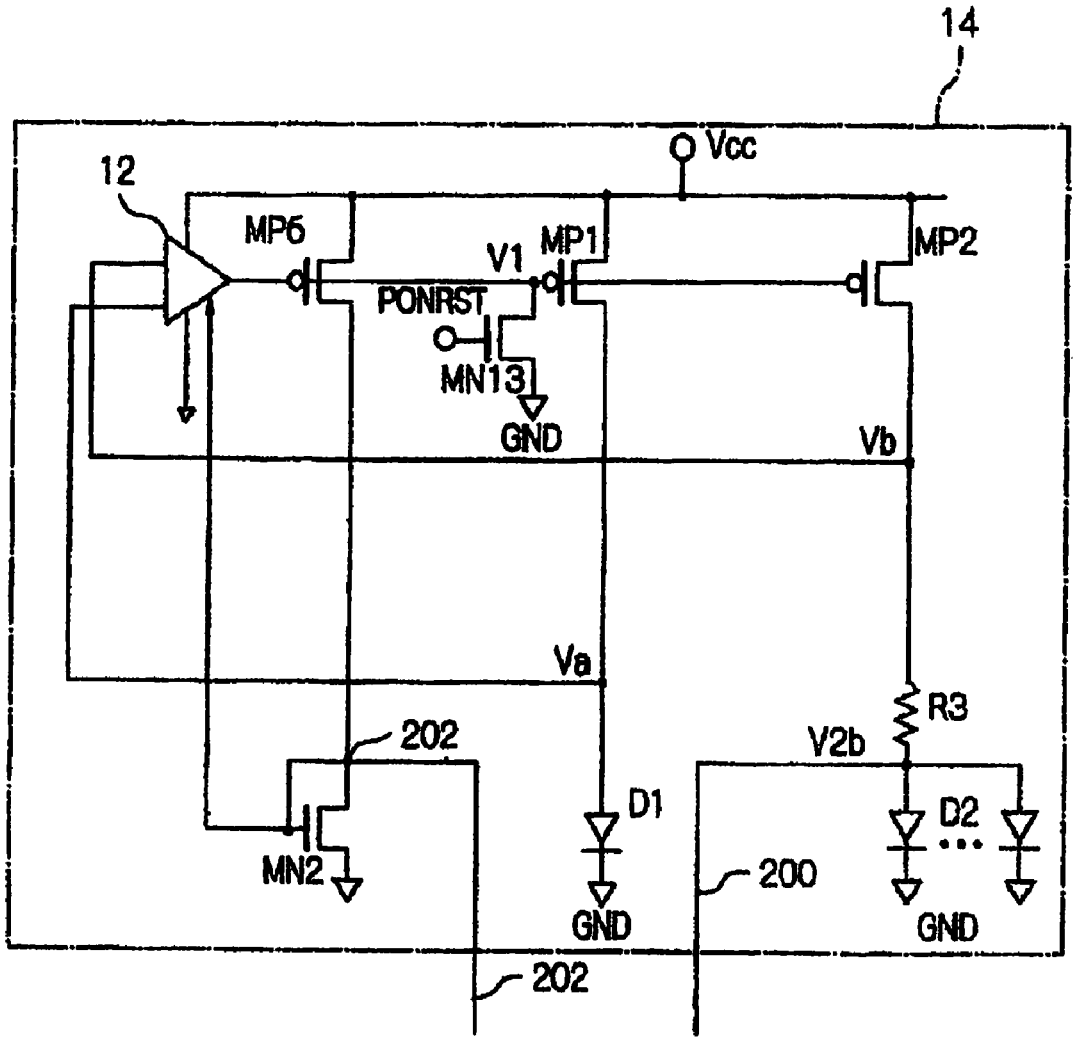
FIG. 2 is a circuit diagram showing another example configuration of the constant current generating circuit.
Figure 3:
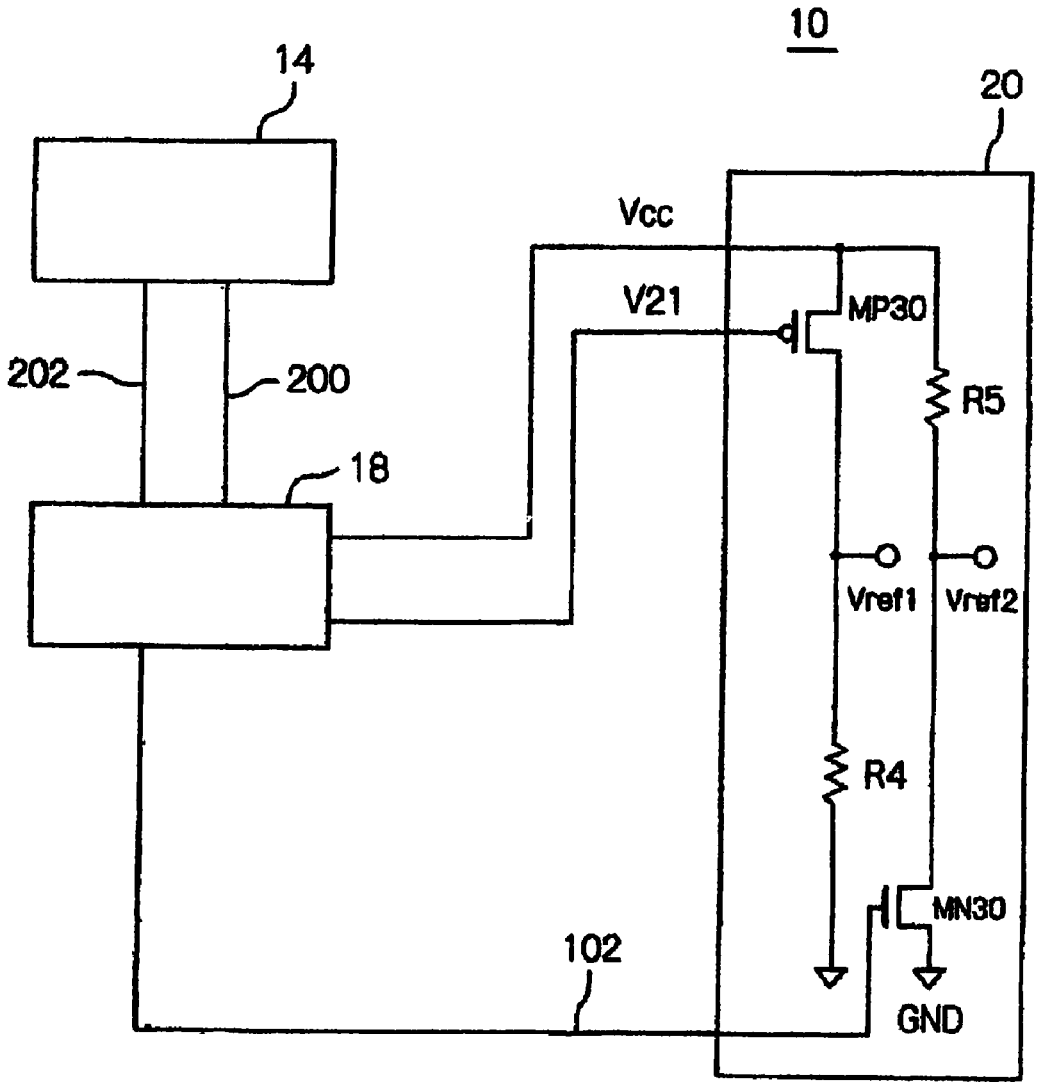
FIG. 3 is a block diagram showing a reference voltage generating circuit to which the principle of the present invention is applied.

As shown in FIG. 2, in the constant current generating circuit 14, a differential amplifier 2 is connected between power terminal Vcc and ground GND. An output of differential amplifier 12 is connected to gates of P-channel MOS type transistors MP1 and MP2. Each of the transistors MP1 and MP2 is a current source transistor. In the constant current generating circuit 14, transistor MP1 and a diode D1 are connected in series via a connection node Va, between power terminal Vcc and ground GND, thereby forming a first current path. Connection node Va in the first current path is connected to one input of differential amplifier 12.

Transistor MP2 and a resistor R3 are connected in series via a connection node Vb, between power terminal Vcc and ground GND. Diodes D2, having current capacity which is n times (n is a natural number greater than 2) as high as the current capacity of diode D1, are connected to the other terminal of resistor R3. Transistor MP2, resistor R3 and diodes D2 thereby form a second current path. Connection node Vb in the second current path is connected to the other input of differential amplifier 12. The connection node V2*b* between the resistor R3 and the diodes D2 is also connected to the constant current generating circuit 18 (FIG. 3) via a connection line 200. In addition, a P-channel MOS type transistor MP6 and an N-channel MOS type transistor MN2 are connected in series via a connection node 202, between power terminal Vcc and ground GND. Connection node 202 is connected to a gate of transistor MN2 and differential amplifier 12. A bias current is applied to differential amplifier 12 through connection node 202.

Differential amplifier 12 generates a constant current in proportion to a thermal voltage, and also a constant current in proportion to a diode voltage. An output of differential amplifier 12 has a positive temperature characteristic. Differential amplifier 12 drives the gates of transistors MP1, MP2 and MP6 (FIG. 2) to maintain the connection nodes Va and Vb at the same potential.

Referring to FIG. 2 again, an N-channel MOS type transistor MN13 is additionally connected to a connection node V1 between transistors MP6 and MP1. Transistor MN13 forces current source transistors MP1 and MP2 to be turned on according to a signal PONRST applied externally from outside constant current generating circuit 14 at the time of input of power.

Next, as shown in FIG. 1, in the constant current generating circuit 18, a P-channel MOS type transistor MP21 and a resistor R1 are connected in series via a connection node Vc2, between power terminal Vcc and ground GND, thereby forming a third current path. The transistor MP21 is a current source transistor. In addition, a P-channel MOS type transistor MP26 and an N-channel MOS type transistor MN22 are connected in series between power terminal Vcc and ground GND. A differential amplifier 16 has one differential input connected to connection line 200 (connection node V2*b*) of constant current generating circuit 14 shown in FIG. 2, and drives current source transistors MP21 and MP26 to maintain the connection node V2*b* and a connection node V2*a* at the same potential.

The resistor R1 in FIG. 1 is connected between the transistor MP21 and ground GND. The resistor R1 includes a plurality of voltage dividing resistors R1-0 to R1-2 whose connection nodes Vc0, Vc1 and Vc2 are respectively connected to N-channel MOS type transistors MNtc0, MNtc1 and MNtc2. The transistors MNtc0 to MNtc2 each serve to select one of the connection nodes Vc0 to Vc2 according to signals Trmc0 to Trmc2, and to apply a voltage of the selected connection node to the connection node V2*a* remaining at a high impedance state. The connection node V2*a* is connected to the differential amplifier 16. The resistor R1 and the transistors MNtc0 to MNtc2 form a trimming circuit that adjusts a negative temperature coefficient in the diodes D1 and D2.

The constant current generating circuit 18 in FIG. 1 also includes a plurality of N-channel MOS type transistors MN2*b*0, MN2*b*1 and MN2*b*2 which are connected to the transistor MN2 (FIG. 2) via connection line 202, and which form a current mirror. N-channel MOS type select transistors MNtb0, MNtb1 and MNtb2 are respectively connected between these transistors MN2*b*0 to MN2*b*1 and the connection node Vc2. In addition, a gate of transistor MP21 is connected to differential amplifier 16 via a connection node V21. The differential amplifier 16 drives current source transistors MP21 and MP26 to maintain the connection node V2*b* and connection node V2*a* in the second current path at the same potential. An N-channel MOS type transistor MN23 is additionally connected to connection node V21 in FIG. 1, and transistor MN23 forces current transistor MP21 to be turned on by the signal PONRST applied externally from outside constant current generating circuit 18 at the time of input of power.

The connection node V21 in FIG. 1 is connected to a P-channel MOS type transistor MP30 in output circuit 20 shown in FIG. 3. In output circuit 20, current source transistor MP30 and resistor R4 are connected in series between power terminal Vcc and ground GND, thereby forming a fourth current path with a connection node between current source transistor MP30 and resistor R4 as output terminal Vref1. A reference voltage Vref1 from ground GND is output from output terminal Vref1.

In addition, resistor R5 and current source N-channel MOS type transistor MN30 are connected in FIG. 3 in series between power terminal Vcc and ground GND, and a gate of current source transistor MN30 is connected to transistor MN22 in constant current generating circuit 18 via a connection line 102, thereby forming a current mirror. In addition, a connection node between resistor R5 and current source transistor MN30 is an output terminal Vref2, whereby transistor MN30 and resistor R5 form a fifth current path. A reference voltage Vref2 from power terminal Vcc is output from output terminal Vref2.

In view of the above described configuration, operation of reference current generating circuit 10 will now be described. First, assuming that transistors MP1, MP2 and MP6 of constant current generating circuit 14 in FIG. 2 have the same transistor size (W (gate width)/L (gate length)), the same current Ids as noted below flows into respective transistors MP1, MP2 and MP6:

$$Ids=1/R3*[kT/q*LN(n)] \quad (1)$$

wherein, k is Boltzmann's constant, T is absolute temperature, q is units of electric charge, and n is diode capacitance ratio (aspect ratio). The current Ids depends on a thermal voltage and has a positive temperature coefficient proportional to the absolute temperature. In addition, as the same current Ids as the current Ids flowing into transistor MP6 flows into transistor MN2, the above equation (1) may be established.

Assuming that transistor MP21 and transistor MP26 of constant current generating circuit 18 in FIG. 1 have the same transistor size (W/L), the same current Ids flows into respective MOS transistors MP21 and MP26. Here, when a select signal is input to one of input terminals Trmb0 to Trmb2, a current IdsMP21 flowing into transistor MP21 amounts to the sum of a current Ir1 flowing through resistor R1 and a current IdsMN2*b* which is a combination of currents flowing into transistors MN2*b*0 to MN2*b*2 selected by input terminals Trmb0 to Trmb2, as shown in equation (2):

$$IdsMP21=IdsMP26=Ir1+IdsMN2b \quad (2).$$

For example, when a high (H) level signal is applied to a selected one of the input terminals Trmc0 to Trmc2 in FIG. 1, and a low (L) level signal is applied to the remaining input terminals, one of the transistors MNtc0 to MNtc2 is selected and is turned on, and a voltage of the connection node V2*a* becomes a voltage of the connection nodes Vc0, Vc1 and Vc2 of voltage dividing serial resistors R1-0 to R1-2 in resistor R1.

The voltage of connection node V2*a* in FIG. 1 becomes equal to input 200 of differential amplifier 16. That is, connection node V2*a* becomes equal to voltage V2*b* of diodes D2 in FIG. 2, according to a negative feedback operation through differential amplifier 16, transistor MP21 and resistor R1. Accordingly, the current Ir1 flowing through resistor R1 becomes Ir1=Vbe/(R1-0) when input terminal Trmc0 goes to a high level and input terminals Trmc1 and Trmc2 go to a low level. Likewise, the current Ir1 flowing through resistor R1 becomes Ir1=Vbe/(R1-0+R1-1) when input terminal Trmc1 goes to a high level and input terminals Trmc0 and Trmc2 go to a low level. Furthermore, the current Ir1 becomes Ir1=Vbe/(R1-0+R1-1+R1-2) when input terminal Trmc2 goes to a high level and input terminals Trmc0 and Trmc1 go to a low level. Accordingly, the current Ir1 can be expressed as follows:

$$Ir1=\alpha*Vbe/R1 \quad (3),$$

wherein α is determined by selection via input terminals Trmc0 to Trmc2 and a division ratio of voltage dividing resistors R1-0 to R1-2 in resistor R1.

As transistor MN2 and transistors MN2*b*0 to MN2*b*2 in FIGS. 1 and 2 form a current mirror, the sum IdsMN2*b* of currents flowing into transistors MN2*b*0 to MN2*b*2 selected by input terminals Trmb0 to Trmb2 can be expressed as follows:

$$IdsMN2b=\beta*(1/R3*[kT/q*LN(n)]) \quad (4),$$

wherein β is determined by selection via input terminals Trmb0 to Trmb2 and a mirror ratio of transistors MN2 and MN2*b*0 to MN2*b*2.

From the above equations (2), (3) and (4), the current IdsMP26 flowing into transistor MP26 can be expressed as shown in equation (5), and a reference current proportional to 1/R1 of a band gap voltage (Vbe+R1/R3*kT/q*LN(n)) having no temperature dependency can be generated:

$$IdsMP26=\alpha*Vbe/R1+\beta*(1/R3*[kT/q*LN(n)])=1/R1*\{\alpha*Vbe+\beta*(R1/R3*[kT/q*LN(n)])\} \quad (5).$$

From the above equation (5), the voltage Vref1 appearing at the output terminal Vref1 of the output circuit 20 in FIG. 3 can be expressed as follows:

$$Vref1=R4*IdsMP26=R4/R1*\{\alpha*Vbe+\beta*(R1/R3*[kT/q*LN(n)])\} \quad (6).$$

Accordingly, it is possible to generate at output terminal Vref1 a constant reference voltage which is R4/R1 times as high as the band gap voltage and which has no temperature dependency.

In the mean time, assuming that the mirror ratio of transistor MN22 and transistor MN30 is one, from the above equation (5), the voltage Vref2 appearing at output terminal Vref2 can be expressed as follows:

$$Vref2=Vcc-R5*IdsMP26=Vcc-R5/R1*\{\alpha*Vbe+\beta*(R1/R3*[kT/q*LN(n)])\} \quad (7).$$

Accordingly, it is possible to generate at output terminal Vref2 a constant reference voltage which is R5/R1 times as high as the band gap voltage from power voltage Vcc and which has no temperature dependency.

Next, a reference current generating circuit according to another embodiment will be described. This embodiment has the same configuration as the above-described first embodiment shown in FIG. 3, except that constant current generating circuit 14 of the first embodiment shown in detail in FIG. 2, is replaced by contact current generating circuit 400 shown in FIG. 4. Explanation of this second embodiment will thus focus on constant current generating circuit 400 shown in FIG. 4, and redundant explanation of the remaining aspects of reference current generating circuit 10 will be omitted for the sake of brevity. In this embodiment, the same components as in the first embodiment are denoted by the same reference numerals.

Figure 4:
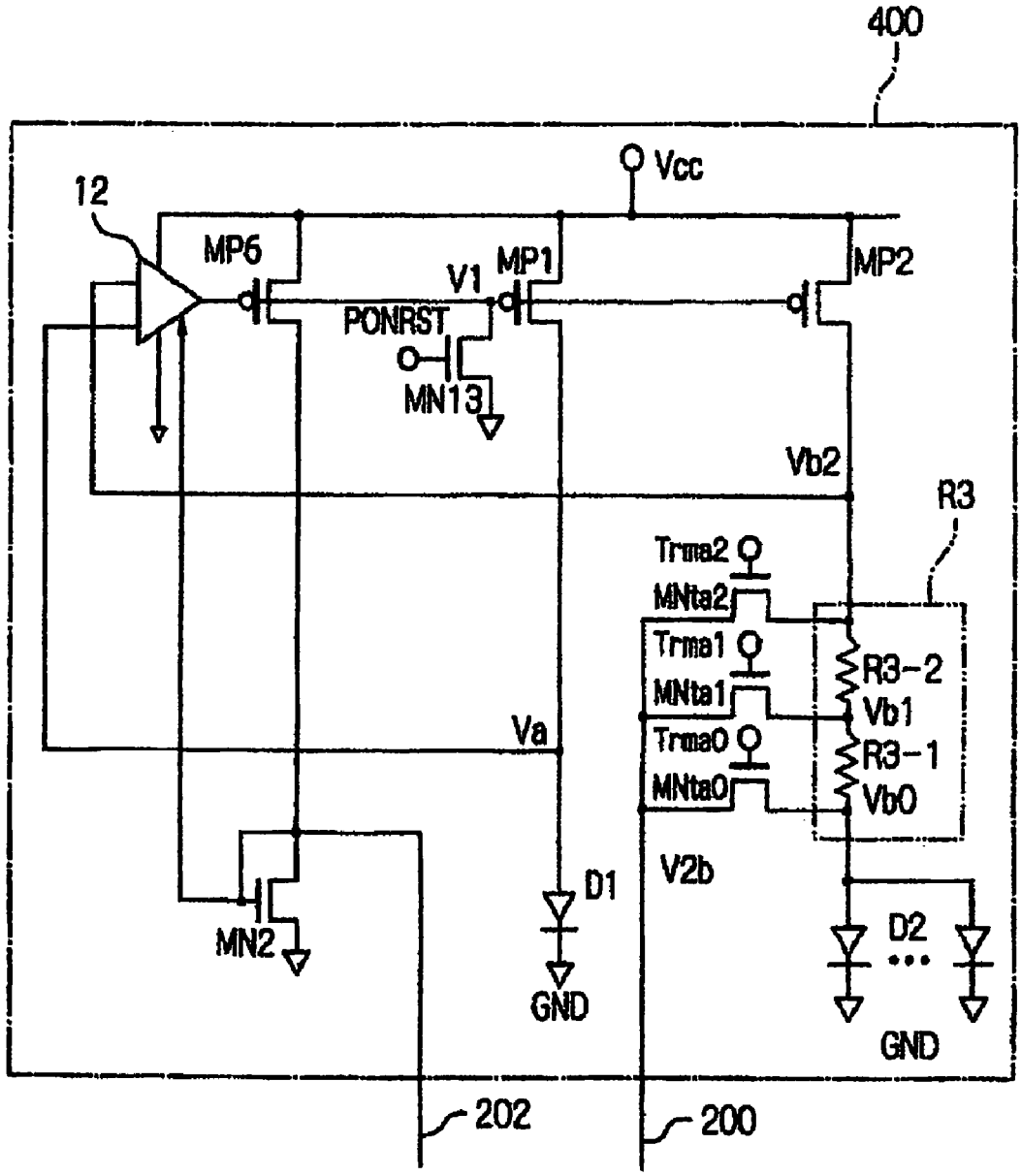
FIG. 4 is a circuit diagram showing another example configuration of the constant current generating circuit.

As shown in FIG. 4, in constant current generating circuit 400 according to this embodiment, a resistor R3 in the second current path includes a plurality of voltage dividing resistors R3-1 and R3-2 connected in series. Transistors MNta0, MNta1 and MNta2 are connected between connection nodes Vb0, Vb1 and Vb2 of voltage dividing resistors R3-1 and R3-2 and input node V2*b* of differential amplifier 16 in constant current generating circuit 18 shown in FIG. 1. Transistors MNta0, MNta1 and MNta2 select one of connection nodes Vb0 to Vb2, transmitting a voltage of the selected connection node to connection node V2*b*. Signals Trma0, Trma1 and Trma2 for selecting a connection node are input to respective gates of transistors MNta0, MNta1 and MNta2, and connection node V2*b* is connected to one input of differential amplifier 16 via connection line 200.

An operation of reference current generating circuit having constant current generating circuit 400 as shown in FIG. 4 will now be described. Assuming that transistors MP1, MP2 and MP6 of constant current generating circuit 400 have the same transistor size (W (gate width)/L (gate length)), the same current Ids flows into respective transistors MP1, MP2 and MP6:

$$Ids=1/R3*[kT/q*LN(n)] \quad (8).$$

As the same current Ids as the current Ids flowing into transistor MP6 flows into transistor MN2, the above equation (8) may be established.

Assuming that transistor MP21 and transistor MP26 in constant current generating circuit 18 shown in FIG. 1 have the same transistor size (W/L), the same current Ids flows into respective transistors MP21 and MP26. In addition, since the current Ids of the transistor MP21 amounts to the sum of a current Ir1 flowing through resistor R1 and a current IdsMN2*b*, which is a combination of currents flowing into transistors MN2*b*0 to MN2*b*2 selected via the input nodes Trmb0 to Trmb2, the current IdsMP21 of transistor MP21 is expressed as follows:

$$IdsMP21=IdsMP26=Ir1+IdsMN2b \quad (9).$$

Here, when a high (H) level signal is applied to a selected one of input nodes Trma0 to Trma2, and a low (L) level signal is applied to the remaining input nodes, one of transistors MNta0 to MNta2 is selected and is turned on, and a voltage of the connection node V2*b* becomes a voltage of the connection nodes Vb0, Vb1 and Vb2 of voltage dividing resistors R3-1 and R3-2 in resistor R3. From the above equation (8), connection nodes Vb0, Vb1 and Vb2 have respective voltages as follows:

$$Vb0=Vbe$$

$$Vb1=Vbe+R3-2/R3*[kT/q*LN(n)]$$

$$Vb2=Vbe+(R3-1+R3-2)/R3*[kT/q*LN(n)]=Vbe+[kT/q*LN(n)].$$

Accordingly, the voltage of connection node V2*b* is as follows: Vb2=Vbe when input node Trma0 goes to a high level and input nodes Trma1 and Trma2 go to a low level, Vb2=Vbe+R3−2/R3*[kT/q*LN(n)] when input node Trma1 goes to a high level and input nodes Trma0 and Trma2 go to a low level, and Vb2=Vbe+[kT/q*LN(n)] when the input node Trma2 goes to a high level and input nodes Trma0 and Trma1 go to a low level.

Accordingly, the voltage V2*b* of connection node V2*b* can be expressed as follows:

$$Vb2=Vbe+\gamma*[kT/q*LN(n)] \quad (10),$$

wherein γ is 0 to 1 and is determined by selection of input nodes Trma0 to Trma2 and a division ratio of voltage dividing resistors R3-1 and R3-2 in resistor R3.

Similarly, when a high level signal is applied to a selected one of the input nodes Trmc0 to Trmc2 of constant current generating circuit 18 and a low level signal is applied to the remaining input nodes, one of transistors MNtc0 to MNtc2 is selected and is turned on, and a voltage of connection node V2*a* becomes a voltage of connection nodes Vc0, Vc1 and Vc2 of voltage dividing resistors R1-0 to R1-2 in resistor R1.

The voltage of connection node V2*a* becomes equal to input 200 of differential amplifier 16, that is the voltage V2*b* of node V2*b*, according to a negative feedback operation through differential amplifier 16, transistor MP21 and resistor R1. Accordingly, the current Ir1 flowing through resistor R1 becomes Ir1=(Vbe+γ*[kT/q*LN(n)])/(R1-0) when input terminal Trmc0 goes to a high level and input terminals Trmc1 and Trmc2 go to a low level, becomes Ir1=(Vbe+γ*[kT/q*LN(n)])/(R1-0+R1-1) when input terminal Trmc1 goes to a high level and input terminals Trmc0 and Trmc2 go to a low level, and becomes Ir1=(Vbe+γ*[kT/q*LN(n)])/(R1-0+R1-1+R1-2) when input terminal Trmc2 goes to a high level and input terminals Trmc0 and Trmc1 go to a low level.

Accordingly, the current Ir1 can be expressed as follows:

$$Ir1=\alpha*(Vbe+\gamma*[kT/q*LN(n)])/R1 \quad (11),$$

wherein α is determined by selection via the input terminals Trmc0 to Trmc2 and a division ratio of voltage dividing resistors R1-0 to R1-2 in resistor R1.

In addition, as transistor MN2 and transistors MN2*b*0 to MN2*b*2 (FIG. 1) form the current mirror, the sum IdsMN2*b* of currents flowing into transistors MN2*b*0 to MN2*b*2 selected by the input nodes Trmb0 to Trmb2 can be expressed as follows:

$$IdsMN2b=\beta*(1/R3*[kT/q*LN(n)]) \quad (12),$$

wherein β is determined by selection via input terminals Trmb0 to Trmb2 and a mirror ratio of transistors MN2 and transistors MN2*b*0 to MN2*b*2.

From the above equations (9), (11) and (12), the current IdsMP26 can be expressed as follows in equation (13), and a reference current proportional to 1/R1 of a band gap voltage (Vbe+R1/R3*kT/q*LN(n)) having no temperature dependency can be generated:

$$IdsMP26=\alpha*(Vbe+\gamma*[kT/q*LN(n)])/R1+\beta*(1/R3*[kT/q*LN(n)])=1/R1*\{\alpha*Vbe+(\beta*R1/R3+\gamma*\alpha)*[kT/q*LN(n)]\} \quad (13).$$

From the above equation (13), the voltage Vref1 appearing at output terminal Vref1 can be expressed as follows:

$$Vref1=R4*IdsMP26=R4/R1*\{\alpha*Vbe+(\beta*R1/R3+\gamma*\alpha)*[kT/q*LN(n)[\} \quad (14).$$

That is, it is possible to generate at the output terminal Vref1 a constant reference voltage which is R4/R1 times as high as the band gap voltage and that has no temperature dependency.

In the mean time, assuming that the mirror ratio of transistor MN22 and transistor MN30 is one, from the above equation (13), the voltage Vref2 appearing at output terminal Vref2 can be expressed as follows:

$$Vref2=Vcc-R5*IdsMP26=Vcc-R5/R1*\{\alpha*Vbe+(\beta*R1/R3+\gamma*\alpha)*[kT/q*LN(n)]\} \quad (15).$$

That is, it is possible to generate at the output terminal Vref2 a constant reference voltage which is R5/R1 times as high as the band gap voltage from the power voltage Vcc and that has no temperature dependency.

As described above, according to the second embodiment, since it is configured that dividing voltage nodes are selected by voltage dividing resistors connected in series to diodes at an diode voltage input side of a differential amplifier that generates a constant current proportional to a diode voltage in order to adjust non-uniformity or dispersion of a reference current, it is possible to further raise precision of adjustment, in addition to the effect of the first embodiment.

What is claimed is:

1. A reference current generating apparatus for generating a reference current, comprising:

a first constant current generator including a first current source transistor and a first diode connected to each other at a first connection node, a second current source transistor and a first resistor connected to each other at a second connection node, a second diode and the first resistor connected to each other at a third connection node, the second diode having a current capacity larger than a current capacity of the first diode, the first connection node and the second connection node respectively connected to inputs of a first differential amplifier that maintains the first and second connection nodes at an identical electric potential, gates of the first and second current source transistors connected to an output of the first differential amplifier, a transistor connected to the output of the first differential amplifier and that turns on the first and second current source transistors at a time when a power supply is turned on, and a third current source transistor connected to a second transistor by a fourth connection node and that biases the first differential amplifier via the fourth connection node;

a second constant current generator including a second differential amplifier having inputs, the third connection node connected to one of the inputs of the second differential amplifier, a fourth current source transistor and a second resistor connected to each other at a fifth connection node, the second resistor having a plurality of voltage dividing resistors connected in series to each other by dividing nodes, a voltage of a selected one of the dividing nodes of the second resistor being applied to another of the inputs of the second differential amplifier, gates of the fourth current source transistor and a fifth current source transistor are connected to an output of the second differential amplifier, a third transistor connected to the output of the second differential amplifier that turns on the fourth current source transistor, the second transistor and a plurality of transistors forming a first current mirror connected to the fifth connection node via respective selected ones of the plurality of transistors to turn on the fourth current source transistor at the time when the power supply is turned on, and the fifth current source transistor connected to a fourth transistor by a sixth connection node and that biases the second differential amplifier via the sixth; and an output circuit including a sixth current source transistor connected to the output of the second differential amplifier, a seventh connection node between the sixth current source transistor and a third resistor providing a first reference output, and the fourth transistor and a fifth transistor connected to each other and forming a second current mirror, and an eighth connection node between the fifth transistor and a fourth resistor providing a second reference output.

2. The reference current generating apparatus according to claim 1, wherein the first resistor is formed by a plurality of second voltage dividing resistors connected in series to each other by second dividing nodes, respective ones of connection nodes of a plurality of sixth transistors are respectively connected to the second dividing nodes of the second voltage dividing resistors, and other connection nodes of the plurality of sixth transistors are connected at the third connection node to the one of the inputs of the second differential amplifier.

3. A reference current generating circuit comprising:

a first constant current generating circuit including a first differential amplifier that sums a constant current proportional to a thermal voltage and a constant current proportional to a diode voltage, to provide a first differential output signal, the first constant current generating circuit generating a bias signal and providing a first current path having a first connection node, responsive to the first differential output signal;

a second constant current generating circuit including a second differential amplifier that provides a second differential output signal responsive to potentials at respective first and second input terminals, the second constant current generating circuit further including a current source transistor and a resistor connected together in series with a second connection node therebetween to provide a second current path, the current source transistor operable responsive to the second differential output signal, the resistor configured to provide a plurality of divided voltages from respective voltage dividing nodes, a switch that selectively connects the voltage dividing nodes to a third connection node, and a current mirror having a selectable mirror ratio and that is responsive to the bias signal to provide current at the second connection node, the first and second input terminals of the second differential amplifier respectively connected to the first and third connection nodes; and an output circuit that provides a constant reference voltage without temperature dependency responsive to the second differential output signal.

4. The reference current generating circuit of claim 3, wherein the first constant current generating circuit further comprises:

a second current source transistor having a control terminal coupled to the first differential output signal, a first terminal connected to a power terminal and a second terminal connected to a fourth connection node;

a second resistor having a first terminal coupled to the fourth connection terminal and having a second terminal coupled to the first connection node;

a plurality of first diodes each having a first terminal connected to the first connection node and a second terminal connected to ground;

a third current source transistor having a control terminal coupled to the first differential output signal, a first terminal connected to the power terminal and a second terminal connected to a fifth connection node; and a second diode having a first terminal connected to the fifth connection node and a second terminal connected to ground, wherein the first differential amplifier having first and second input terminals respectively connected to the fourth connection node and the fifth connection node, and wherein the second diodes have a current capacity greater than the first diode.

5. The reference current generating circuit of claim 4, wherein the second resistor comprises a plurality of dividing resistors connected together in series with second dividing nodes therebetween at which a plurality of second divided voltages are provided, the first constant current generating circuit further comprising:

a plurality of selection transistors each having a first terminal connected to respective ones of the second dividing nodes and the first connection node, a second terminal coupled to the first input terminal of the second differential amplifier and a control terminal coupled to control signals.

6. The reference current generating circuit of claim 3, wherein the resistor includes a plurality of voltage dividing resistors connected together in series with the voltage dividing nodes therebetween, the switch comprises a plurality of transistors each having a first terminal connected to respective ones of the voltage dividing nodes, a second terminal connected to the third connection node, and a control terminal connected to respective control signals.

7. The reference current generating circuit of claim 3, wherein the current mirror comprises:

a plurality of mirror transistors each having a control terminal coupled to the bias signal, a first terminal connected to ground, and a second terminal; and a plurality of selection transistors connected to respective ones of the mirror transistors, the selection transistors each having a control terminal coupled to control signals, a first terminal connected to the second terminal of the respective mirror transistor, and a second terminal connected to the second connection node.

8. The reference current generating circuit of claim 3, wherein said first current generating circuit further comprises:

a second current source transistor and a second transistor connected together in series and having a fourth connection node therebetween, the second current source transistor operable responsive to the first differential output signal to provide the bias signal from the fourth connection node to the first differential amplifier.

9. The reference current generating circuit of claim 3, wherein the second constant current generating circuit further comprises:

a second current source transistor and a second transistor connected together in series with a fourth connection node therebetween, the second current source transistor operable responsive to the second differential output signal to provide a second bias signal from the fourth connection node to the second differential amplifier, the output circuit further providing a second constant reference voltage without temperature dependency responsive to the second bias signal.

* * * * *